US007293483B1

(12) United States Patent
Hutchings et al.

(10) Patent No.: US 7,293,483 B1
(45) Date of Patent: Nov. 13, 2007

(54) SELF ALIGNING SOCKET SET

(76) Inventors: Robert Hutchings, 806 Singing Drum Dr., Henderson, NV (US) 89015; Daniel Jara, 2574 Cherokee Ct., Turloca, CA (US) 95380

( * ) Notice: Subject to any disclaimer, the term of this patent is extended or adjusted under 35 U.S.C. 154(b) by 0 days.

(21) Appl. No.: 11/464,745

(22) Filed: Aug. 15, 2006

(51) Int. Cl.
*B25B 13/06* (2006.01)
*B25B 13/56* (2006.01)
*B25B 13/00* (2006.01)

(52) U.S. Cl. ..... 81/124.4; 81/177.2

(58) Field of Classification Search ..... 81/124.3, 81/124.4, 177.2, 121.1
See application file for complete search history.

(56) References Cited

U.S. PATENT DOCUMENTS 2,991,678 A * 7/1961 Adolphson ..... 81/185
4,602,534 A * 7/1986 Moetteli ..... 81/177.85
4,882,958 A * 11/1989 McNeeley ..... 81/124.4
D353,756 S * 12/1994 Graves ..... D8/29
6,389,931 B1 * 5/2002 Delaney et al. ..... 81/60
6,951,156 B2 * 10/2005 Garg ..... 81/121.1
7,036,401 B2 * 5/2006 Carroll ..... 81/177.2

* cited by examiner

*Primary Examiner*—David B Thomas
(74) *Attorney, Agent, or Firm*—Russell S. Krajec; Krajec Patent Offices, LLC

(57) ABSTRACT

A socket tool has an internal hole that is adapted to receive a standard size thread corresponding to the size of the nut being driven. A set of such socket tools may be driven using one or more hollow extensions that engage a socket tool, the extension having a hollow portion adapted to receive the largest standard size thread of the set of socket tools. In some embodiments, an adapter tool may connect various driving tools to either a socket tool or an extension.

17 Claims, 3 Drawing Sheets

300
PARTIAL CROSS-SECTIONAL VIEW OF SOCKET TOOL WITH ALIGNMENT HOLE

SELF ALIGNING SOCKET SET

BACKGROUND

Socket wrenches are tools designed to drive an external feature, typically an external hex, with a recess adapted to fit the feature. The typical socket tool is a cylindrical sleeve with a hex recess in one end, the driving end, and a driven end that may have a recess to receive a drive wrench. A socket tool may be used with various drive tools to drive a bolt head or may be used to drive a nut over a threaded portion of a rod or bolt.

In general, a user aligns a socket wrench over a nut or bolt with his hands. Many socket wrenches provide a chamfer on the edge of the drive end to facilitate the alignment. The user generally needs to align the centerline of the socket wrench with the centerline of the nut or bolt by eye, then rotate the socket wrench until the shape of the nut or bolt aligns with the internal shape of the socket wrench.

SUMMARY

A socket tool has an internal hole that is adapted to receive a standard size thread corresponding to the size of the nut being driven. A set of such socket tools may be driven using one or more hollow extensions that engage a socket tool, the extension having a hollow portion adapted to receive the largest standard size thread of the set of socket tools. In some embodiments, an adapter tool may connect various driving tools to either a socket tool or an extension.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Specific embodiments of the subject matter are used to illustrate specific inventive aspects. The embodiments are by way of example only, and are susceptible to various modifications and alternative forms. The appended claims are intended to cover all modifications, equivalents, and alternatives falling within the spirit and scope of the invention as defined by the claims.

Throughout this specification, like reference numbers signify the same elements throughout the description of the figures.

When elements are referred to as being "connected" or "coupled," the elements can be directly connected or coupled together or one or more intervening elements may also be present. In contrast, when elements are referred to as being "directly connected" or "directly coupled," there are no intervening elements present.

Figure 1:
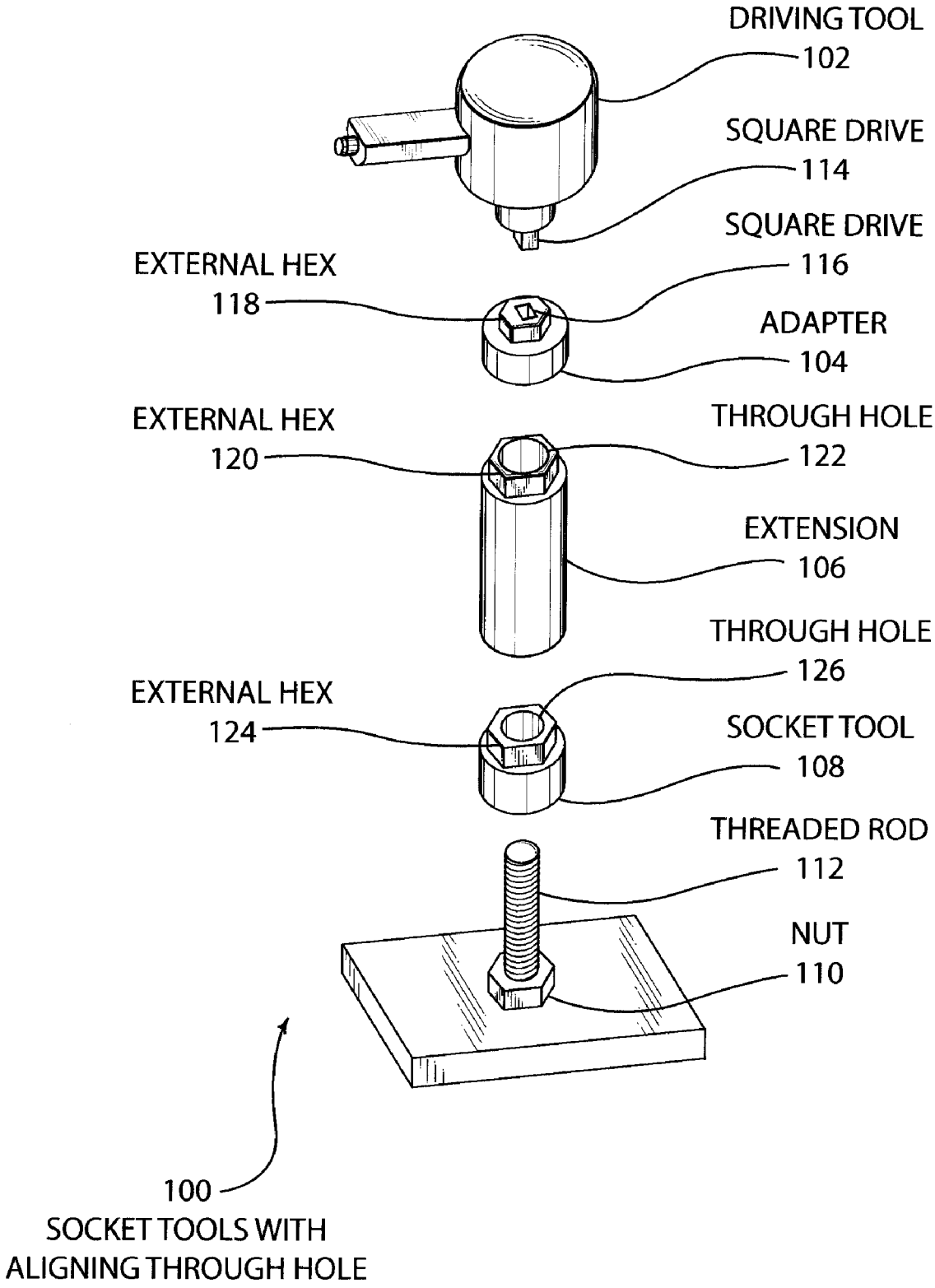
FIG. 1 is a pictorial illustration of an embodiment showing a socket tool system with an aligning through hole.

FIG. 1 is an exploded view of an embodiment 100 showing socket tools having an alignment through hole. The driving tool 102 is attached to an adapter 104, which is connected to an extension 102, which in turn is attached to a socket tool 108. The socket tool 108 engages a nut 110 on a threaded rod 112.

Embodiment 100 is one example of a deep depth socket tool that uses a through hole to align the socket tool 108 on the threaded rod 112 in order to easily and quickly engage the nut 110. The through hole 126 is sized so that it engages the threaded rod 112 in a running fit, which inherently aligns the receiving end of the socket tool 108 with the nut 110. The operator may turn the socket tool 108 by hand to engage the hex feature of the nut, or may use the driving tool 102 to cause the socket tool 108 to turn.

The driving tool 102 may be any type of tool that can be used to cause the socket tool 108 to turn. The driving tool 102 may be a pneumatic impact wrench as illustrated or may be any type of pneumatic, electric, hand operated, or other manual or automatic mechanism for imparting torque. For example, a manual or pneumatic ratchet wrench, electric drill, or even a spanner wrench that engages the external hex 118 may be used.

The adapter 104 may be used to transfer torque from the square drive 116 that receives the square drive 114 of the driving tool 102 to the extension 106 by engaging the external hex 120 of the extension 106. The adapter 104 engages the extension 106 through an internal hex shape not shown in the present figure. The driven end of the adapter 104 is the end that receives torque through the square drive 116 or external hex 118. The driving end of the adapted 104 is the end that engages the external hex 120 of the extension 106.

Similarly, the extension 106 may be used to transfer torque from the external hex 120 to the external hex 124 of the socket tool 108 through an internal hex shape at the end of the extension 106 closest to the socket tool 108. The internal hex shape is not shown in the figure. The driven end of the extension 106 is the end having the external hex 120 and the driving end is the end that engages the socket tool 108 using the external hex 124.

The embodiment 100 may include a set of interchangeable socket tools 108 for different sized nuts. For each socket tool 108 in the set, the through hole 126 may correspond with the standard size threaded rod 112 that corresponds with the size of the nut 110 driven by the particular socket tool 108. By having a through hole 126 that is appropriately sized for the application, the centerline of the socket tool 108 may easily and simply align with the centerline of the threaded rod 112 and thus may only need to be aligned, if at all, by a slight rotation of the socket tool assembly.

The extension 106 has a through hole 122 that traverses the length of the extension 106. The through hole 122 defines a maximum size of a threaded rod that can fit into the extension 106.

The embodiment 100 may be used in many different configurations. Since the external hex 120 on the extension 106 is the same size as the external hex 124 on the socket tool 108, the extension 106 may be removed from the assembly. In such a configuration, the adapter 104 may engage the socket tool 108 directly to drive the nut 110. Of course, such a configuration would be appropriate when the threaded rod 112 does not protrude as much as in the present figure.

In another configuration, two or more extensions 106 may be used in series to extend the socket tool 108 further from the adapter 104. Such a configuration may be useful when access to the nut 110 is restricted and the operator is located further away, or when the threaded rod 112 protrudes even more than in the present figure.

In some embodiments, various mechanisms may be employed to removably yet positively engage the components of the socket tool system, i.e., the adapter 104, the extension 106, and the socket tool 108. For example, a spring clip, ball plunger, or other retaining mechanism may engage a surface or feature on a mating portion of the socket tool system. In some instances, a recess, detent, groove, or other feature may be formed in one component that may engage a spring loaded device in another component. Such features may enable the components of the socket system to positively engage each other and not separate during normal handling.

In this application the term threaded rod may include the threaded portion of any component, such as a bolt, screw, shaft, or any other threaded portion.

Figure 2:
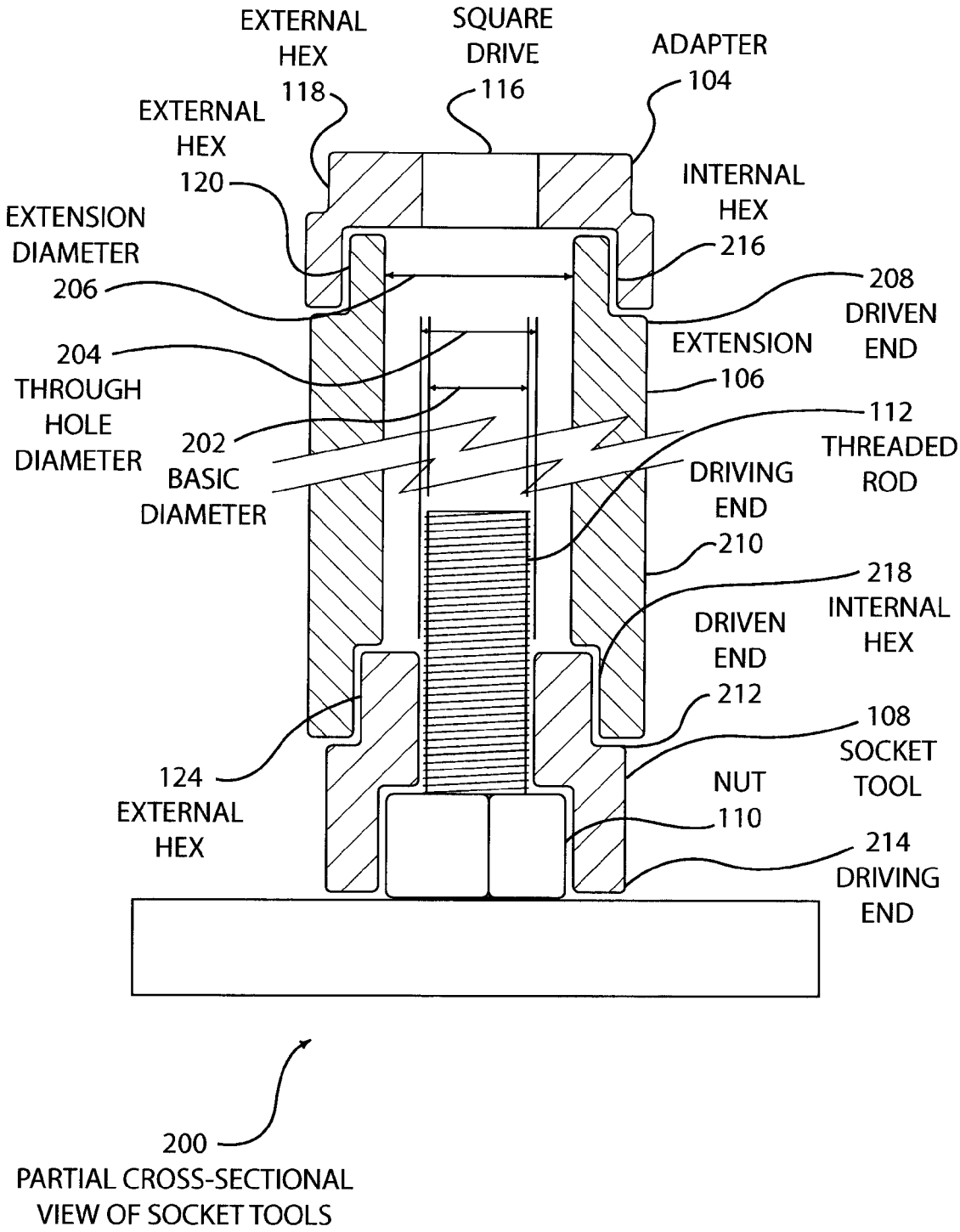
FIG. 2 is a partial cross-sectional illustration of the embodiment of FIG. 1.

FIG. 2 is a partial cross-sectional illustration 200 of embodiment 100. The components of the socket tool system are shown in cross-section, including the adapter 104, the extension 106, and the socket tool 108.

The adapter 104 has the square drive 116, the external hex 118, and an internal hex 216, that engages the external hex 120 of the extension 106. The extension 106 has a driven end 208 and a driving end 210. The driving end 210 has an internal hex 218 that engages the external hex 124 of the socket tool 108. The socket tool 108 has a driven end 212 and a driving end 214 that engages the nut 110.

The threaded rod 112 has a basic diameter 202. The basic diameter 202 is approximately the largest outside diameter of a thread and also may be known as the nominal size for the thread. For example, a 1/2-13 UNC thread, the outside or basic diameter should range from 0.4985 inches to 0.4870 inches. In another example, an M16×2, class 6 g thread should range from 15.962 mm to 15.682 mm. Various standards bodies, including ANSI, have defined standard sizes and tolerances for many different thread and nut sized.

Each size threaded rod 112 has a corresponding size nut 110. For example the 1/2-13 UNC thread in the previous example has a standard size hexagon (or 'hex') nut that measures between 0.820 and 0.812 inches across the flats. This would correspond to a standard ⅞ inch wrench.

Thus, for each size of nut 110, there is a corresponding major or basic diameter 202. The through hole diameter 204 is sized so that the threaded rod 112 may slip through the diameter 204 but have sufficient locating abilities so that the socket tool 108 may be easily aligned. In many embodiments, the size of the through hole diameter 204 may be sized to be any type of running fit, especially a loose running fit, as defined by ANSI B4.1-1969, R1979. In other embodiments, a locational clearance fit may be used. In many cases, the fit may be a loose running clearance fit plus 20 to 40 percent of a diameter defined by said first basic dimension thread.

Figure 3:
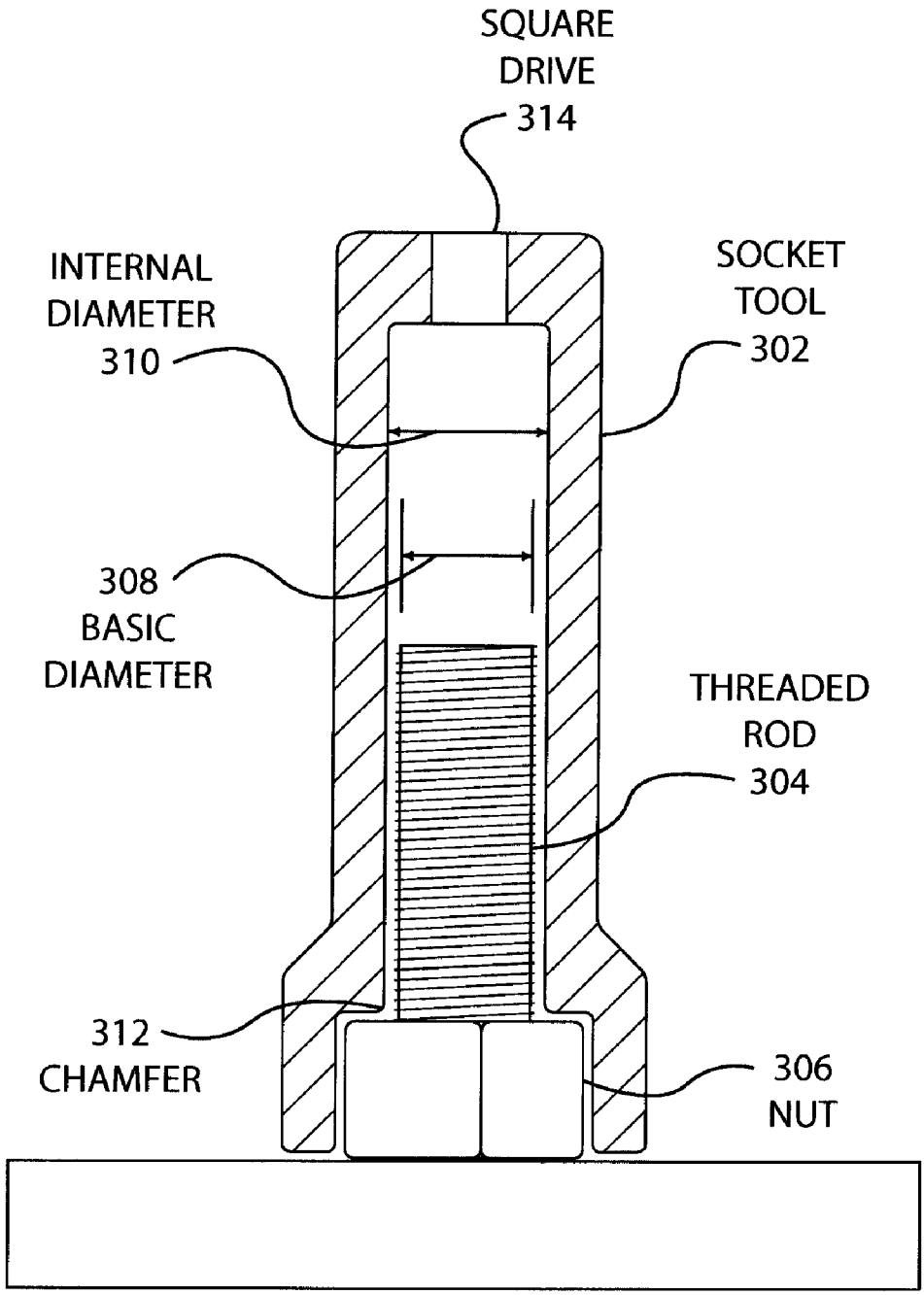
FIG. 3 is a partial cross-sectional illustration of an embodiment showing a single piece socket tool with an alignment hole.

FIG. 3 is a partial cross-sectional view of an embodiment 300 of a socket tool with an alignment hole. A socket tool 302 slips over a threaded rod 304 to engage a nut 306. The threaded rod 304 has a basic diameter 308 that fits inside an internal diameter 310 of the socket tool 302. The socket tool 302 may be driven by a square drive 314 and may have a chamfer 312 that helps guide the socket tool 302 over the threaded rod 304 during installation.

Embodiment 300 is an example of a single piece socket tool 302 that has an internal diameter 310 that is sized to fit over the basic diameter 308 of the threaded rod 304. When the socket tool 302 is installed over the threaded rod 304, the internal diameter 310 allows the centerline of the socket tool 302 to accurately align to the centerline of the threaded rod 304 and thus ease the alignment of the socket tool over the nut 306. The tolerances and sizing of the internal diameter 310 may be similar to that discussed in the embodiment 100 above.

In some embodiments, the square drive 314 may be any type of engagement to a torque device. For example, a handle may be affixed to the socket tool 302 to provide hand torque, or a detachable ratchet wrench, pneumatic impact wrench, electric drill, or other torque generating device may be applied.

The foregoing description of the subject matter has been presented for purposes of illustration and description. It is not intended to be exhaustive or to limit the subject matter to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A socket set comprising:

a driving attachment comprising:

a driving end having an internal hex shape defining a maximum basic dimension thread for a standard nut adapted to be engaged by said internal hex shape;

a driven end;

a socket attachment comprising:

a driving end having an internal feature adapted to drive a first nut having a first basic dimension thread being the same size or smaller than said maximum basic dimension thread;

a round recess adapted to receive a threaded rod of said first basic dimension thread with a clearance, said clearance being no larger than a loose running clearance fit plus 20 percent of a diameter defined by said first basic dimension thread;

a driven end adapted to engage said driving end of said driving attachment.

2. The socket set of claim 1 wherein said clearance is at least a loose running clearance fit.

3. The socket set of claim 1 wherein said clearance is at least a locational clearance fit.

4. The socket set of claim 1 wherein said driving end of said driving attachment comprises a retention feature.

5. The socket set of claim 4 wherein said retention feature comprises a spring retainer that engages a corresponding feature in said driven end of said socket attachment.

6. The socket set of claim 1 wherein said driven end of said driving attachment comprises a receiver for a square drive.

7. The socket set of claim 1 wherein said driven end of said driving attachment comprises an external hex.

8. The socket set of claim 1 further comprising:

an extension tube comprising:

a driven end adapted to engage said driving end of said driving attachment;

a driving end adapted to engage said driven end of said socket attachment; and a through hole being at least a maximum basic dimension of said maximum basic dimension thread size.

9. A socket tool comprising:

a driving end having an internal feature adapted to drive a nut having a basic dimension thread;

a round recess adapted to receive a threaded rod of said basic dimension thread with a clearance, said clearance being no larger than a loose running clearance fit plus 20 percent of a diameter defined by said first basic dimension thread;

a driven end adapted to engage said driving end of a driving attachment.

10. The socket tool of claim 9 wherein said clearance is at least a loose running clearance fit.

11. The socket tool of claim 9 wherein said clearance is at least a locational clearance fit.

12. A socket system comprising:

a driving attachment comprising:

a driving end having an internal hex shape defining a maximum basic dimension thread for a standard nut adapted to be engaged by said internal hex shape;

an internal hollow hole corresponding to a clearance hole for said maximum basic dimension thread;

a driven end;

a socket attachment comprising:

a driving end having an internal feature adapted to drive a first nut having a first basic dimension thread being the same size or smaller than said maximum basic dimension thread;

a round recess adapted to receive a threaded rod of said first basic dimension thread with a clearance, said clearance being no larger than a loose running clearance fit plus 20 percent of a diameter defined by said first basic dimension thread;

a driven end adapted to engage said driving end of said driving attachment.

13. The socket system of claim 12 wherein said driving attachment comprises:

a driving attachment;

an extension tube comprising:

a driven end adapted to engage said driving end of said driving attachment;

a driving end adapted to engage said driven end of said socket attachment; and a through hole being at least a maximum basic dimension of said maximum basic dimension thread size.

14. The socket system of claim 13 wherein said clearance is at least a loose running clearance fit.

15. The socket system of claim 13 wherein said clearance is at least a locational clearance fit.

16. The socket system of claim 13 wherein said driving end of said driving attachment comprises a retention feature.

17. The socket system of claim 16 wherein said retention feature comprises a spring retainer that engages a corresponding feature in said driven end of said socket attachment.

* * * * *